US008465012B2

(12) United States Patent
Ishikawa et al.

(10) Patent No.: US 8,465,012 B2
(45) Date of Patent: Jun. 18, 2013

(54) CREASING DEVICE AND IMAGE FORMING SYSTEM

(75) Inventors: Naoyuki Ishikawa, Kanagawa (JP); Hitoshi Hattori, Tokyo (JP); Naohiro Kikkawa, Kanagawa (JP); Shuuya Nagasako, Kanagawa (JP); Takashi Saito, Kanagawa (JP); Yuusuke Shibasaki, Kanagawa (JP); Hidetoshi Kojima, Miyagi (JP); Naoki Oikawa, Miyagi (JP); Go Aiba, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/067,061

(22) Filed: May 5, 2011

(65) Prior Publication Data

US 2011/0301011 A1 Dec. 8, 2011

(30) Foreign Application Priority Data

Jun. 2, 2010 (JP) ..... 2010-127180

(51) Int. Cl.
*B31F 1/08* (2006.01)

(52) U.S. Cl.
USPC ..... 270/45; 270/46; 270/58.07

(58) Field of Classification Search
USPC ..... 270/32, 37, 45, 46, 58.07; 493/59, 493/240, 242, 355, 396, 397
See application file for complete search history.

(56) References Cited

U.S. PATENT DOCUMENTS

| | | | | |
|---|---|---|---|---|
| 7,631,858 | B2 * | 12/2009 | Harada | 270/58.07 |
| 7,740,238 | B2 * | 6/2010 | Iijima et al. | 270/37 |
| 7,770,876 | B2 * | 8/2010 | Sasahara | 270/32 |
| 7,913,988 | B2 * | 3/2011 | Awano | 270/45 |
| 7,954,798 | B2 * | 6/2011 | Taguchi et al. | 270/52.17 |
| 2009/0121408 | A1 * | 5/2009 | Awano | 270/37 |
| 2009/0181840 | A1 * | 7/2009 | Awano | 493/399 |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |
| 2011/0130260 | A1 * | 6/2011 | Kikkawa et al. | 493/405 |
| 2011/0301005 | A1 * | 12/2011 | Hattori et al. | 493/23 |
| 2011/0301008 | A1 * | 12/2011 | Shibasaki et al. | 493/405 |

FOREIGN PATENT DOCUMENTS

| | | |
|---|---|---|
| JP | 2000198613 A | 7/2000 |
| JP | 2009166928 A | 7/2009 |
| JP | 2011-057438 | 3/2011 |

* cited by examiner

*Primary Examiner* — Leslie A Nicholson, III

(74) *Attorney, Agent, or Firm* — Harness, Dickey & Pierce, P.L.C.

(57) ABSTRACT

A creasing device that creases sheets on a per-sheet basis and includes: a first member extending perpendicularly to a sheet conveying direction and including a convex blade; a second member extending perpendicularly to the sheet conveying direction and including a concave blade, into which the convex blade is to be fitted; a drive unit that brings the first and the second members into and out of contact with each other, thereby producing a crease in a sheet interposed between the first and the second members; a sheet retainer driven by the drive unit and brought into contact with the second member with the sheet therebetween to retain the sheet across its full width; and a holding unit that holds the sheet retainer in a retaining state during creasing where the contact between the first and the second members starts at one point and develops in one direction.

10 Claims, 17 Drawing Sheets

CREASING DEVICE AND IMAGE FORMING SYSTEM

CROSS-REFERENCE TO RELATED APPLICATIONS

The present application claims priority to and incorporates by reference the entire contents of Japanese Patent Application No. 2010-127180 filed in Japan on Jun. 2, 2010.

BACKGROUND OF THE INVENTION

1. Field of the Invention

The present invention relates to a creasing device that preliminary produces a fold mark or a crease in a sheet member (hereinafter, "sheet") delivered from a preceding stage before the sheet is folded and to an image forming system that includes the creasing device and an image forming apparatus.

2. Description of the Related Art

What is called saddle-stitch or center-folded booklet production has been conventionally performed by saddle stitching a sheet batch, which is a stack of a plurality of sheets delivered from an image forming apparatus, and folding the thus-saddle-stitched sheet batch in the middle of the sheet batch. Folding such a sheet batch containing a plurality of sheets causes outside sheets of the sheet batch to be stretched at a fold line by a greater amount than inside sheets. An image portion formed at the fold line on outside sheets can thus be stretched, resulting in damage, such as come off of toner, to the image portion in some cases. A similar phenomenon can occur when other fold, such as z-fold or tri-fold, is performed. A sheet batch can be folded insufficiently depending on the thickness of the sheet batch.

A creasing device called a creaser that produces a fold mark (a crease) in a sheet batch prior to a folding process where the sheet batch undergoes half fold or the like to make outside sheets easy to fold, thereby preventing come off of toner have already been known. Some types of such creasing devices produce a crease in a sheet in a direction perpendicular to a sheet conveying direction by moving a roller on the sheet, burning the sheet with a laser beam, pressing a creasing blade against the sheet, or a like method.

However, producing the crease in a sheet with the roller involves moving the roller across a full length of the sheet in a direction, along which a fold extends, and therefore is time consuming. This can be resolved by rotating the sheet conveying direction by 90 degrees and producing a crease parallel to the sheet conveying direction; however, this scheme involves an effect on footprint and therefore is disadvantageous in view of space-saving. Creasing by using a laser beam is environmentally less favorable because smoke and odor are given off during creasing.

Creasing a sheet by pressing a creasing blade against the sheet can be performed in a relatively short period of time and allows easy production of a crease perpendicular to a sheet conveying direction; however, pressing a longitudinal face of the creasing blade against the sheet entirely at once causes a high load. To reduce the load, a scheme of bringing the creasing blade face into contact with a sheet in multiple batches can be used. However, this scheme is disadvantageous in that unevenness can develop between a portion that contacts the blade multiple times and a portion that contacts the blade only once and also in that producing a crease by making contact in multiple batches can decrease productivity.

To solve the inconveniences discussed above, it is possible to reduce a load placed on a creasing moving unit by bringing a creasing blade gradually into contact with a sheet from an edge of the sheet and causing a creasing unit to contact the sheet only once; however, this causes a pressure applied onto a center portion of the sheet to be weakened, making it difficult to produce an even crease.

To that end, creasing a sheet gradually from an edge of the sheet to reduce a load during creasing and bringing the creasing unit into contact with the sheet only once for production of an even crease is conceivable. To perform this, it is necessary to retain a sheet to prevent displacement of the sheet during creasing; however, if this sheet retaining operation is performed concurrently with the creasing operation, the sheet is retained only at a portion, which gradually shifts from an edge of the sheet. This can disadvantageously cause displacement of the sheet to occur during creasing.

To that end, a technique of moving a creasing member by using a plurality of individually-advancing-and-retracting mechanisms, which are activated at different times, so as to enable formation of a crease while reducing a pressing force for a creasing member is disclosed in, for instance, Japanese Patent Application Laid-open No. 2009-166928.

A technique of aligning edges of sheets by, when the sheets are cut, pressing a top surface of a batch of the sheets by a first pressing unit, which is capable of ascending and descending to press the batch placed on a sheet stacking unit at a portion near a fold of the batch, by, after a lapse of a predetermined period of time, pressing the batch at a portion near an edge of the batch by a second pressing unit, which is capable of ascending and descending to press the batch, and by, thereafter, trimming the edges of the sheets by a cutting unit, which is capable of ascending and descending is disclosed in Japanese Patent Application Laid-open No. 2000-198613. In this technique, consideration is given to prevention of displacement of the sheet batch.

However, the technique disclosed in Japanese Patent Application Laid-open No. 2009-166928 can disadvantageously cause a crease to have unevenness between a portion of a sheet that comes into contact with a creasing blade multiple times and a portion of the sheet that comes into contact with the creasing blade only once. This technique is also disadvantageous in that it is necessary to retain the sheets at different times by using a plurality of individually-advancing-and-retracting mechanisms to prevent displacement of the sheets during creasing, which also disadvantageously makes the structure complicated.

The technique disclosed in Japanese Patent Application Laid-open No. 2000-198613 prevents displacement of sheets by using the first and the second pressing units to pressing the sheet at different times during sheet cutting; however, the structure according to this technique is complicated as is the structure of the technique disclosed in Japanese Patent Application Laid-open No. 2009-166928. Furthermore, the technique disclosed in Japanese Patent Application Laid-open No. 2000-198613 is for a mechanism that imposes a force of a relatively large magnitude for edge trimming, and not appropriate for a mechanism that performs creasing by placing a relatively light load.

SUMMARY OF THE INVENTION

It is an object of the present invention to at least partially solve the problems in the conventional technology.

According to an aspect of the present invention, there is provided a creasing device that creases sheets on a per-sheet basis. The creasing device includes: a first member extending in a direction perpendicular to a sheet conveying direction and including a convex blade, the convex blade having a convex cross section; a second member extending in a direction perpendicular to the sheet conveying direction and including a concave blade, the concave blade allowing the convex blade to be fitted thereinto with a sheet interposed between the concave blade and the convex blade; a drive unit that brings the first member and the second member into and out of contact with each other to cause a sheet stopped at a predetermined position to be pinched between the first and the second members and creased; a sheet retainer driven by the drive unit and brought into contact with a top surface of the second member with the sheet interposed between the sheet retainer and the second member to retain the sheet across a full width of the sheet; and a holding unit that holds the sheet retainer in a retaining state during creasing where the convex blade and the concave blade come into contact with each other with the sheet interposed therebetween, the contact starting at one point and developing in one direction.

According to another aspect of the present invention, there is provided an image forming system including: the above-mentioned creasing device; and an image forming apparatus that forms an image on the sheets.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
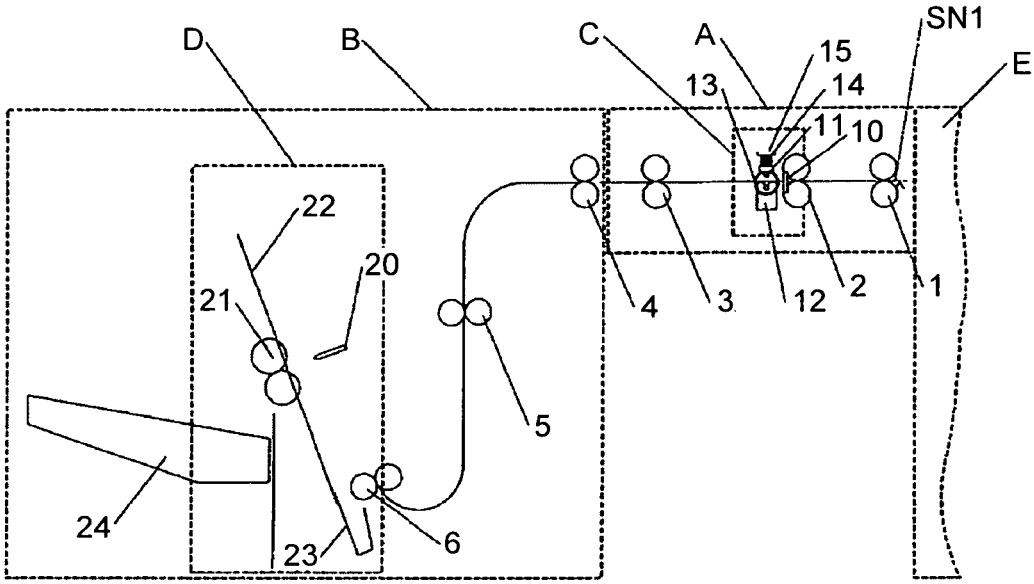
FIG. 1 is a diagram illustrating a schematic configuration of an image forming system according to an embodiment of the present invention.

In embodiments discussed below, a reference symbol A corresponds to a creasing device; a creasing blade 11*a* corresponds to a convex blade; a creasing member 11 corresponds to a first member; a creasing channel 12*a* corresponds to a concave blade, a receiving member 12 corresponds to a second member; a drive mechanism 30M corresponds to a driving unit; a sheet retaining member 42 corresponds to a sheet retainer; a set of a third cam 41*a* and a fourth cam 41*b*, a first positioning member 43*a* and a second positioning member 43*b*, and a support 45 corresponds to a holding unit; a set of a first spring fixing unit 50*a* and a second fixing unit 50*b* correspond to a pressure changing unit; a reference symbol E corresponds to an image forming apparatus. A traveling speed of the sheet retainer depends on a rotation speed of a drive motor 30 and a relationship between the third and the fourth cams 41*a* and 41*b* and third and force positioning members 43*a* and 43*b*.

The present invention is intended to, during creasing, to move a creasing blade entirely, but to bring the creasing blade into contact with a sheet gradually from an edge of the sheet to thereby reduce a load placed on a creasing moving unit, and to bring a creasing unit into contact with the sheet only once to thereby produce an even crease, wherein it is intended that a sheet retaining mechanism, for use in retaining a position of the sheet during creasing, is configured to be driven by a same drive source as that for a creasing mechanism and to retain the sheet across a full width of the sheet along a direction perpendicular to a sheet conveying direction from a front end to a rear end of the sheet all together so that displacement of the sheet during creasing can be lessened.

Exemplary embodiments of the present invention are described below with reference to the accompanying drawings.

FIG. 1 is a diagram illustrating a schematic configuration of an image forming system according to an embodiment of the present invention. The image forming system includes an image forming apparatus E that forms an image on a sheet of paper, a creasing device A that creases the sheet, and a folding device B that performs folding (post-processing).

The image forming apparatus E forms a visible image pertaining to image data fed from a scanner, a personal computer (PC), or the like on a sheet of paper. The image forming apparatus E uses a known print engine of electrophotography, droplet ejection printing, or the like.

Figure 26:
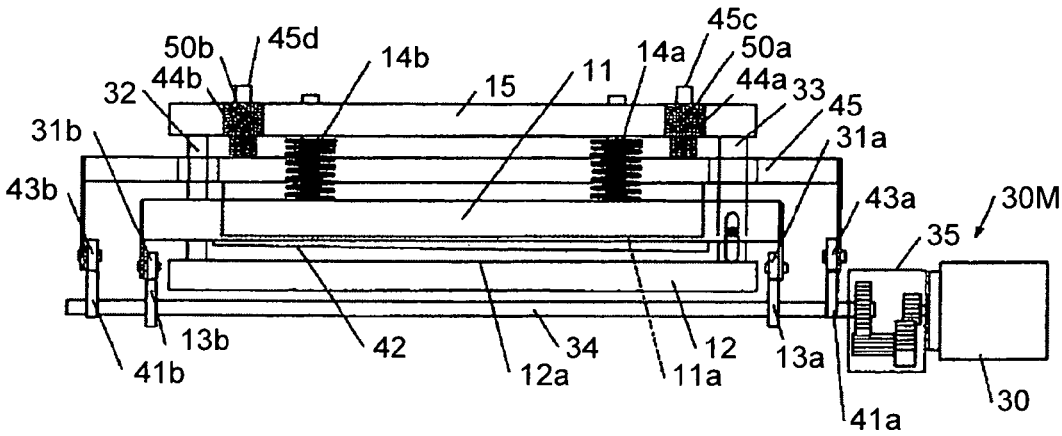
FIG. 26 is a schematic diagram illustrating a pressure-adjusting mechanism of the sheet retaining mechanism illustrated in FIG. 22 and FIG. 23.

The creasing device A includes a conveying mechanism and a creasing unit C. The creasing unit C includes the creasing member 11 and the receiving member 12 and performs creasing by pinching a sheet of paper (hereinafter, "sheet") between the creasing member 11 and the receiving member 12 to produce a linear crease. As illustrated in FIG. 26, which will be described later, the creasing member 11 includes, on an end surface facing the receiving member 12, the creasing blade (crease blade, convex blade) 11*a* for use in producing a crease. The creasing blade 11*a* extends linearly in a direction perpendicular to a sheet conveying direction. A distal end of the creasing blade 11*a* is pointed like a blade. A creasing channel 12*a* (concave blade) is cut in the receiving member 12 on a surface facing the creasing blade 11*a*. The creasing channel 12*a* allows the creasing blade 11*a* to be fitted thereinto. The creasing member 11 and the receiving member 12 have such shapes as discussed above; accordingly, when a sheet is pinched between them, these shapes of the distal end (the convex blade) and the channel (the concave blade) produce a crease in the sheet.

The creasing member 11 is constantly resiliently urged by a resilient member 14, e.g., a compression spring, toward the receiving member 12 and moved up and down by a cam 13. Meanwhile, an upper end of the resilient member 14 in FIG. 1 is confined by a spring fixing member 15.

In this example, the conveying mechanism includes a first pair of conveying rollers 1, a second pair of conveying rollers 2, and a third pair of conveying rollers 3 and conveys a sheet delivered from the image forming apparatus E to a subsequent stage. An entrance sensor SN1 is provided immediately upstream of the first conveying rollers 1, which are located most upstream among the conveying rollers. The entrance sensor SN1 detects a leading edge and a trailing edge of a sheet delivered into the creasing device A. A stopper plate 10, on which a leading edge of a sheet is to abut, is provided immediately downstream of the second conveying rollers 2 provided in the creasing unit C. The stopper plate 10 is capable of ascending and descending relative to a conveyance path.

The folding device B includes a center-folding device D that performs folding. The sheet creased by the creasing device A is conveyed into the folding device B, in which a fourth pair of conveying rollers 4, a fifth pair of conveying rollers 5, and a sixth pair of conveying rollers 6 deliver the sheet to the center-folding device D.

The center-folding device D includes a center-folding tray 22, a trailing-edge fence 23 provided at a lower end (most upstream in the conveying direction) of the center-folding tray 22, a folding plate 20 and a pair of folding rollers 21 configured to fold a sheet along a crease, and a stacking tray 24. The trailing-edge fence 23 evens up sheet edges in the sheet conveying direction by causing a return roller (not shown) to forcibly press trailing edges of sheets discharged onto the center-folding tray 22 against the railing-edge fence 23. A jogger fence (not shown) also evens up sheet edges in the direction perpendicular to the conveying direction.

The folding plate 20 presses its distal-end edge against the evened-up sheet batch along the crease, thereby pushing it into a nip between the folding rollers 21. The sheet batch pushed into the nip between the folding rollers 21 is folded in the nip. When saddle-stitching is to be performed, the sheet batch is stitched by a stitching device (not shown) at a portion to be folded, and thereafter subjected to this folding process, what is called half fold. The half-folded sheet batch is discharged onto and stacked on the stacking tray 24.

Figure 2:
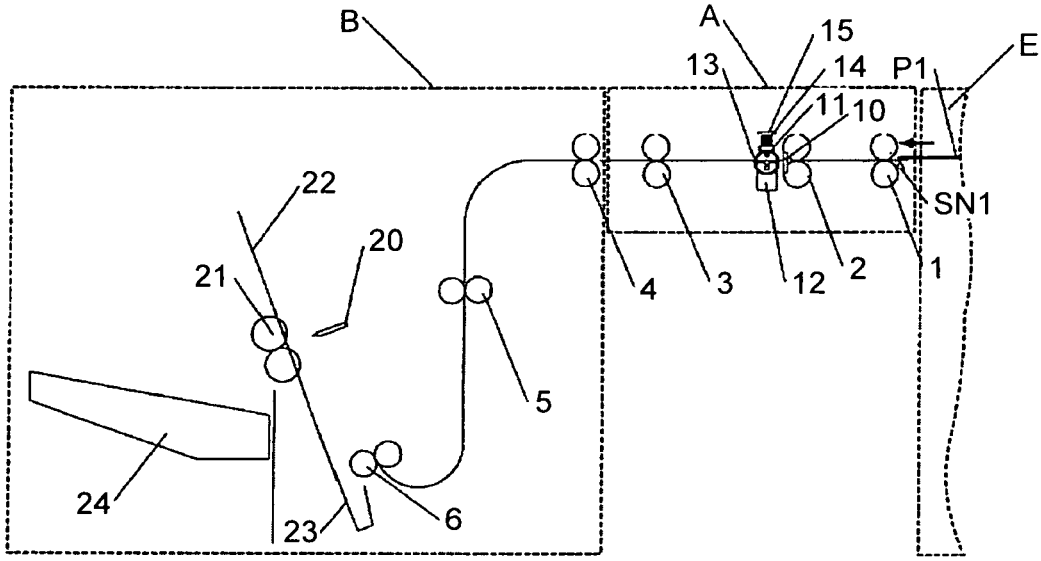
FIG. 2 is a schematic explanatory diagram of a series of operations, including folding, performed by the image forming system and illustrating a situation where a sheet is conveyed into a creasing device.
Figure 3:
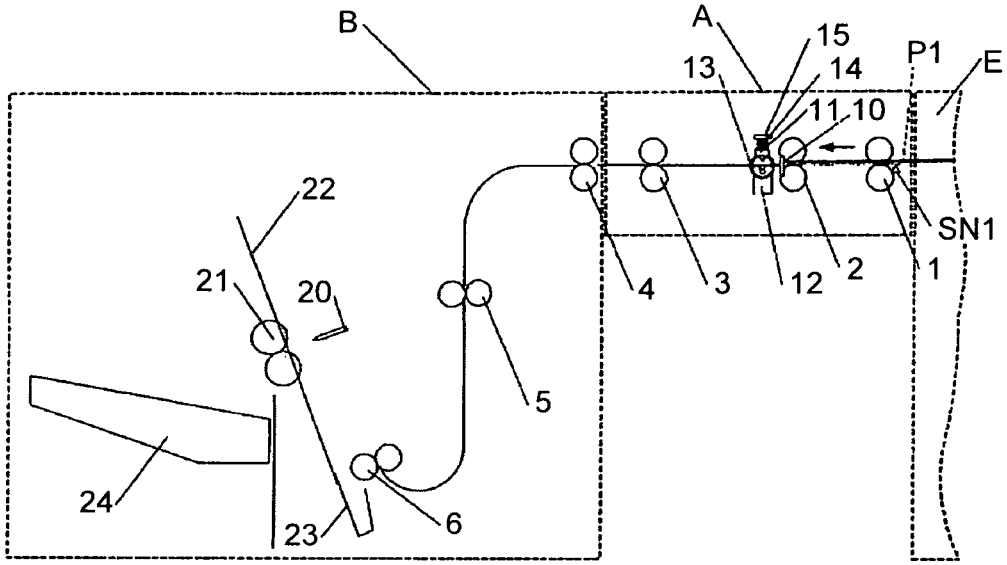
FIG. 3 is a schematic explanatory diagram of the series of operations, including folding, performed by the image forming system and illustrating a situation where a leading edge of the sheet abuts on a stopper plate for skew correction.
Figure 4:
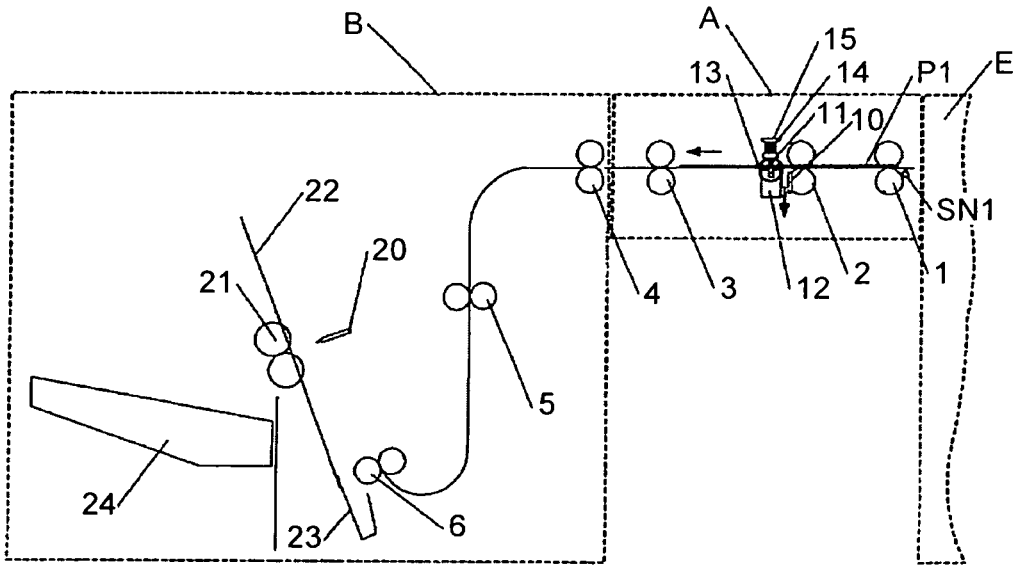
FIG. 4 is a schematic explanatory diagram of the series of operations, including folding, performed by the image forming system and illustrating a situation where the leading edge of the sheet is conveyed to a position immediately upstream from conveying rollers located downstream after the skew correction.

FIG. 2 to FIG. 12 are schematic explanatory diagrams of a series of operations, including the folding process, to be performed by the image forming system. In this image forming system, a sheet P1, on which an image has been formed by the image forming apparatus E, is conveyed into the creasing device A (FIG. 2). For skew correction, a leading edge of the sheet is caused to abut on the stopper plate 10 projecting into the conveyance path (FIG. 3). The sheet P1 thus undergoes skew correction. Thereafter, the stopper plate 10 retracts from the conveyance path as indicated by an arrow, and conveyance of the sheet P1 is resumed and stopped at a creasing position (FIG. 4). The creasing position is determined depending on when the entrance sensor SN1 has detected the leading edge of the sheet and the size of the sheet.

Figure 5:
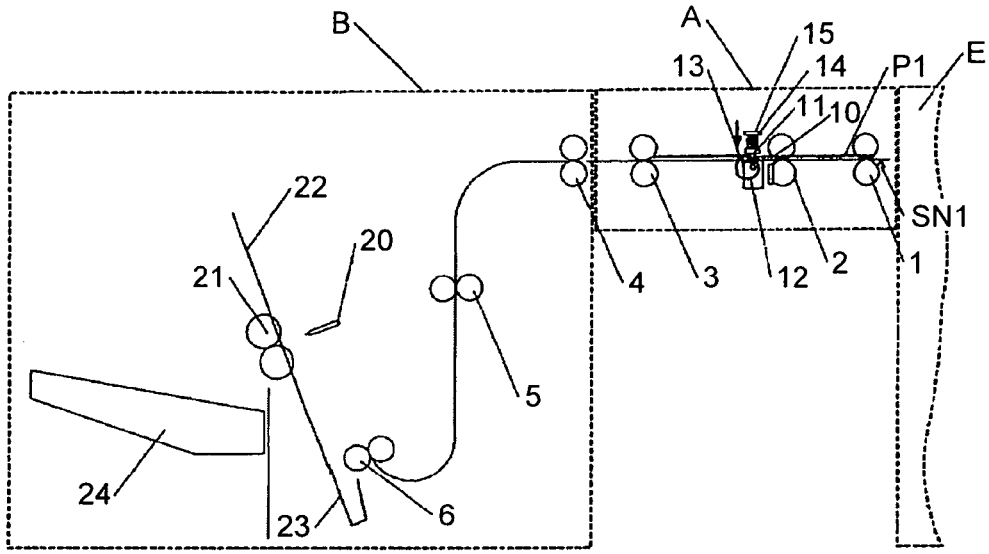
FIG. 5 is a schematic explanatory diagram of a series of operations, including folding, performed by the image forming system and illustrating a situation where creasing is being performed.
Figure 6:
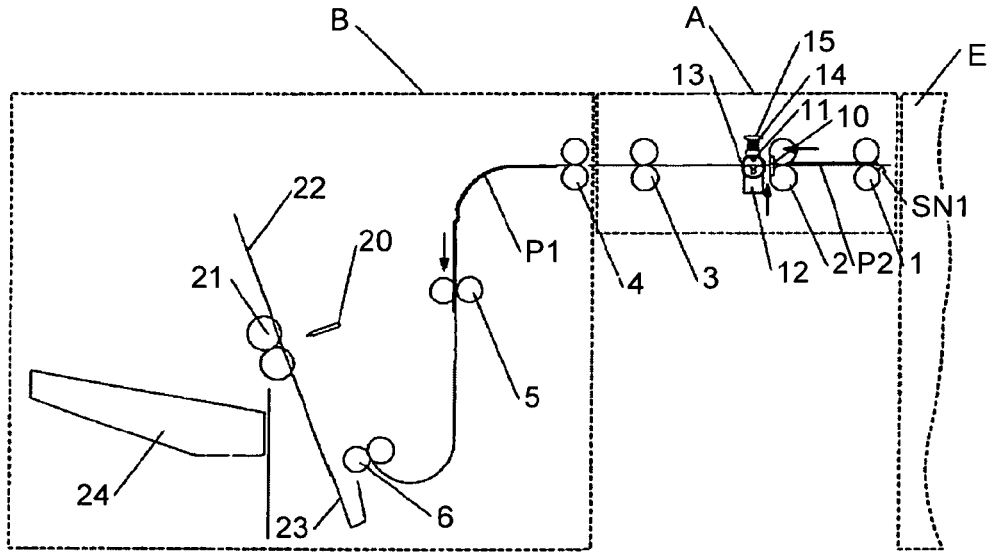
FIG. 6 is a schematic explanatory diagram of a series of operations, including folding, performed by the image forming system and illustrating a situation where the creased sheet has been delivered into a folding device and a second sheet is conveyed into the creasing device.
Figure 7:
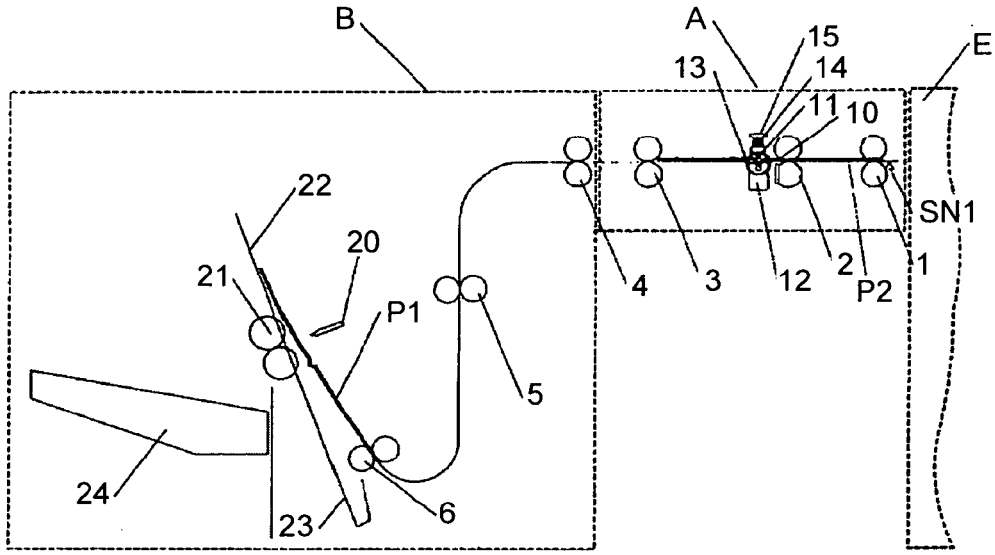
FIG. 7 is a schematic explanatory diagram of the series of operations, including folding, performed by the image forming system and illustrating a situation where the second sheet stopped at a creasing position is being creased.

For the sheet P1 stopped at this position, the cam 41*a* and the cam 41*b* (see FIG. 26) are rotated, causing the creasing member 11 to descend and pinch the sheet P1 between the creasing member 11 and the receiving member 12. At this time, the resilient member 14 exerts a predetermined resilient force, by which a crease is produced (FIG. 5). Thereafter, the thus-creased sheet P1 is conveyed to the folding device B (FIG. 6) and temporarily stored in the center-folding tray 21 (FIG. 7). Concurrently, a subsequent sheet P2 is delivered from the image forming apparatus E into the creasing device A.

Figure 8:
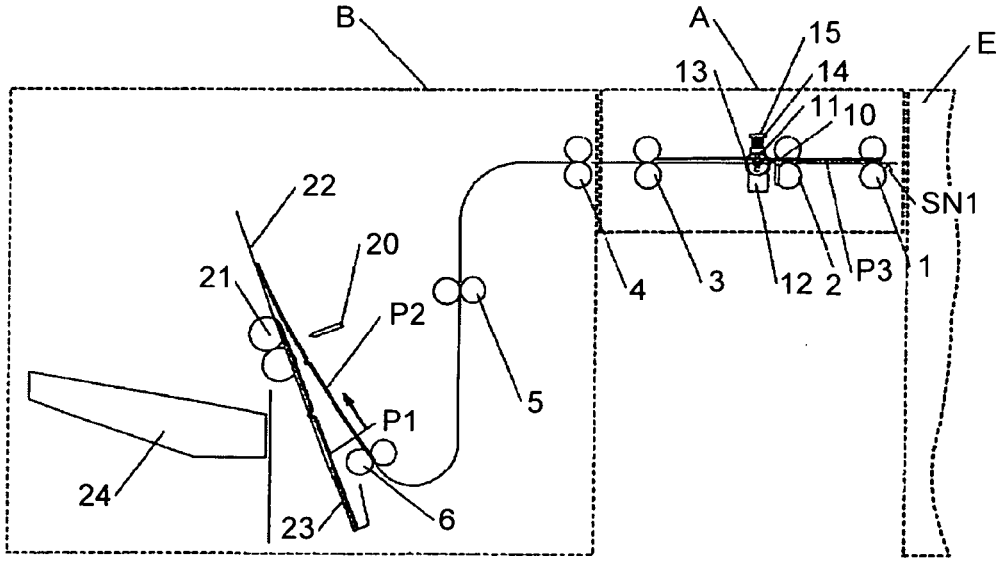
FIG. 8 is a schematic explanatory diagram of the series of operations, including folding, performed by the image forming system and illustrating a situation where a third sheet is being creased.
Figure 9:
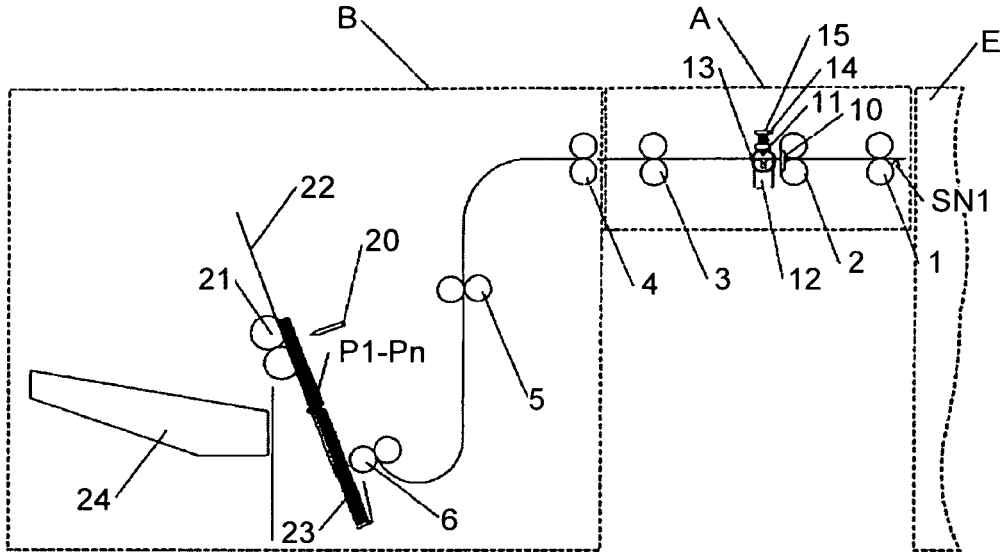
FIG. 9 is a schematic explanatory diagram of the series of operations, including folding, performed by the image forming system and illustrating a situation where a final sheet has been stacked on a center-folding tray.
Figure 10:
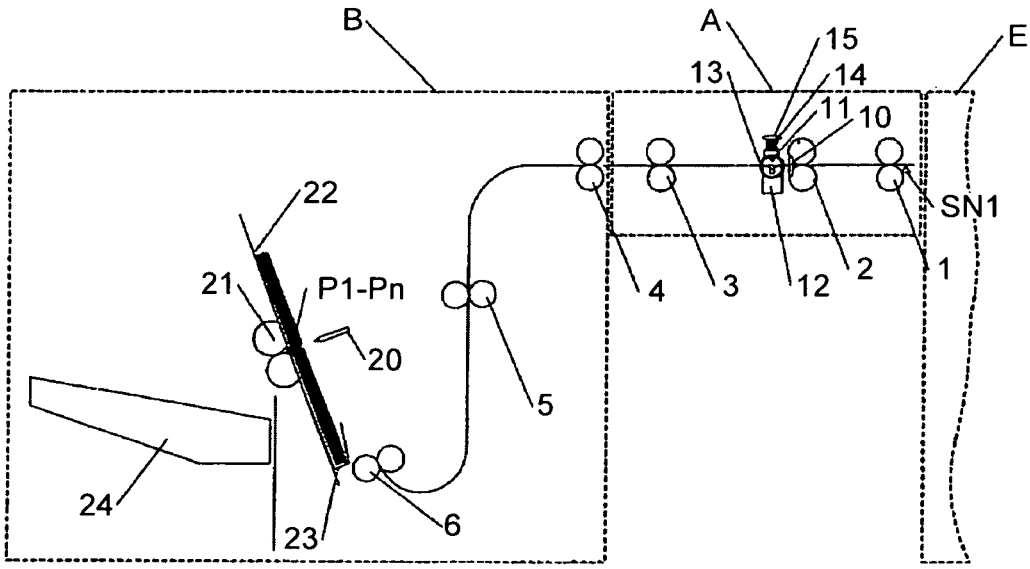
FIG. 10 is a schematic explanatory diagram of the series of operations, including folding, performed by the image forming system and illustrating a situation where the sheet batch is to a center-fold position moved from the state illustrated in FIG. 9.
Figure 11:
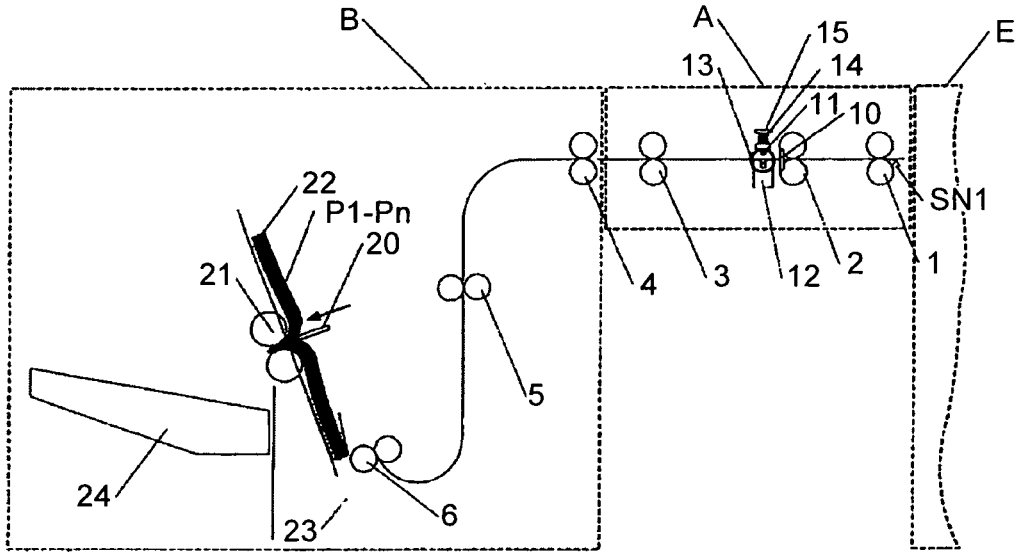
FIG. 11 is a schematic explanatory diagram of the series of operations, including folding, performed by the image forming system and illustrating a situation where the sheet batch illustrated in FIG. 10 undergoes center folding.
Figure 12:
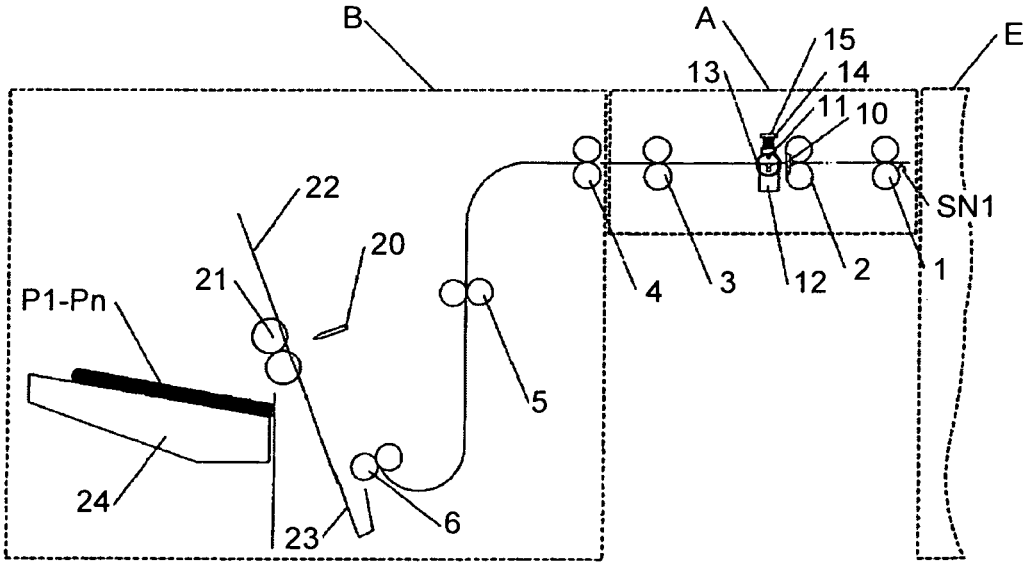
FIG. 12 is a schematic explanatory diagram of a series of operations, including folding, performed by the image forming system and illustrating a situation where the center-folded sheet batch is delivered onto a stacking tray.

The operations mentioned above with reference to FIG. 2 to FIG. 7 are repeatedly performed for a predetermined number of sheets (FIG. 8). When a sheet batch (P1-Pn) containing a predetermined number of sheets (P1 to Pn) is stored in the center-folding tray 22 (FIG. 9), the trailing-edge fence 23 is moved (upward) to place the crease in the sheet batch on a folding position (FIG. 10). Thereafter, the folding plate 20 is pressed against the creases in the sheets to push the creases into the nip between the folding rollers 21, thereby performing folding (FIG. 11). The sheet batches folded into a booklet form are sequentially stacked on the stacking tray 24 (FIG. 12).

The series of operations from sheet creasing (scoring) to folding is performed in this manner. Although not shown, the creasing device A is capable of adapting to other fold mode, such as tri-fold, Z-fold, or closed-gate fold, by producing creases (creases) whose number corresponds to the number of times folding is to be performed.

Figure 13:
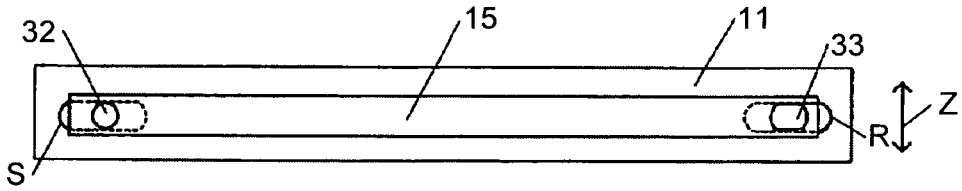
FIG. 13 is a plan view of a main part of a creasing unit for illustration of the configuration.
Figure 14:
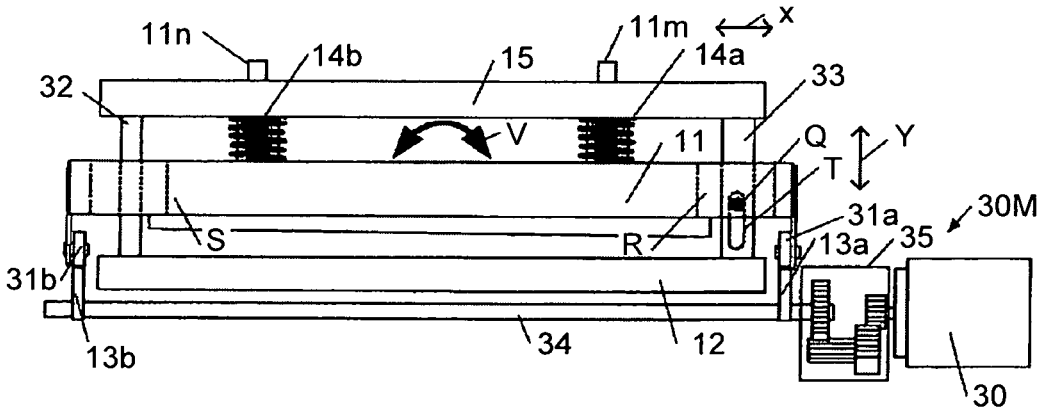
FIG. 14 is an elevation view of the main part of the creasing unit for illustration of the configuration.

The configuration of the creasing unit C that performs the creasing mentioned above is illustrated in detail in FIG. 13, which is a plan view of a main part of the creasing unit C, and in FIG. 14, which is an elevation view (an elevation view of those illustrated in the plan view of FIG. 13). Referring to FIG. 13 and FIG. 14, the creasing unit C includes the creasing member 11 (the creasing blade 11*a* and a body of the creasing member 11), the receiving member 12, and the drive mechanism 30M.

The creasing member 11 has, in addition to the creasing blade 11*a* provided at the lower end of the creasing member 11, a first elongated hole R at a rear and a second elongated hole and S at a front, into which a first support shaft 33 and a second support shaft 32, which will be described later, are loosely fit, respectively, and includes a first positioning member 31*a* and a second positioning member 31*b* at a rear end portion and a front end portion, respectively. The first and the second elongated holes R and S are elongated in a direction perpendicular to the sheet conveying direction and configured to allow the first and the second support shafts 33 and 32 to pivot in a plane perpendicular to the sheet conveying direction but not to allow movement in the sheet conveying direction, relative to the first and the second elongated holes R and S. The first and the second positioning members 31*a* and 31*b* extend substantially vertically downward from the front end portion and the rear end portion of the body of the creasing member 11. The first and the second positioning members 31*a* and 31*b* are disciform cam followers that are rotatably supported at their centers and brought into contact with a first cam 13*a* and a second cam 13*b* to be rotated. Meanwhile, a front side of the device is depicted on the left-hand side in FIG. 13 and FIG. 14.

The receiving member 12 is coupled to the spring fixing member 15 located above the creasing member 11 via the first and the second support shafts 33 and 32 and moved integrally with the spring fixing member 15. A first shaft member 11*m* at a rear and a second shaft member 11*n* at a front are provided on the spring fixing member 15 at two longitudinal end portions of the creasing member 11. A first resilient member 14*a* and a second resilient member 14*b* (which are collectively referred to as "the resilient member 14") are mounted on an outer periphery of the shaft member 11*m* and an outer periphery of the shaft member 11*n*, respectively, thereby constantly resiliently urging the spring fixing member 10 upward, and accordingly the receiving member 12 upward. The first support shaft 33 is formed to have a semicircular cross-sectional profile taken along short sides in a rectangular cross section and loosely fit in the first elongated hole R. A third elongated hole T that is vertically elongated is defined in the first support shaft 33 at a portion lower than a middle portion of the first support shaft 33. A rotating shaft Q is vertically inserted into the third elongated hole T from a side-surface of the creasing member 11 (in a direction perpendicular to the plane of FIG. 14). The diameter of the rotating shaft Q is set to such a size, relative to the width of the third elongated hole T, that allows the rotating shaft Q to move in Y-directions in FIG. 14 but prevents the same from moving in X-directions. This allows the first support shaft 33 to rotate about the rotating shaft Q and move in the longitudinal direction of the third elongated hole T. These configurations mentioned above allow pivoting motion as indicated by an arrow V in FIG. 14.

The drive mechanism 30M is a mechanism that rotates the first and the second cams 13*a* and 13*b*, which are in contact with the positioning members 31*a* and 31*b*, to press the creasing member 11 against the receiving member 12 and move the creasing member 11 away from receiving member 12. The drive mechanism 30M includes a camshaft 34, to which the first cam 13*a* and the second cam 13*b* are coaxially coupled at a rear portion and a front portion, respectively, a drive gear train 35 that drives the camshaft 34 at an end (in the present embodiment, a rear end portion) of the camshaft 34, and the drive motor 30 that drives the drive gear train 35. The first and the second cams 13*a* and 13*b* are located at positions where the first cam 13*a* and the second cam 13*b* are opposed to the first positioning member 31*a* and the second positioning member 31*b* and are to abut thereon, respectively. The first and the second cams 13*a* and 13*b* bring the creasing member 11 toward and away from the receiving member 12 according to distances between a center of the camshaft 34 and rotation centers of the positioning members 31*a* and 31*b* on straight lines passing through the center of the camshaft 34 and the rotation centers of the positioning members 31*a* and 31*b*. At this time, a position of the creasing member 11 is confined by the first and the second support shafts 33 and 32 and the first and the second elongated holes R and S. The creasing member 11 reciprocates under this confined state. A configuration that causes the creasing blade 11*a* of the creasing member 11 to come into contact with the receiving member 12 in a state where the creasing blade 11*a* is inclined relative to the receiving member 12 rather than parallel with the receiving member 12 so as to crease a sheet at an oblique angle according to shapes of the first and the second cams 13*a* and 13*b* is employed.

FIG. 15 to FIG. 20 are schematic illustrations of operations performed to crease a sheet (form a fold mark on a sheet) by using the creasing member 11. Creasing starts when the drive motor 30 starts rotating in response to an instruction fed from a control circuit (not shown).

Figure 15:
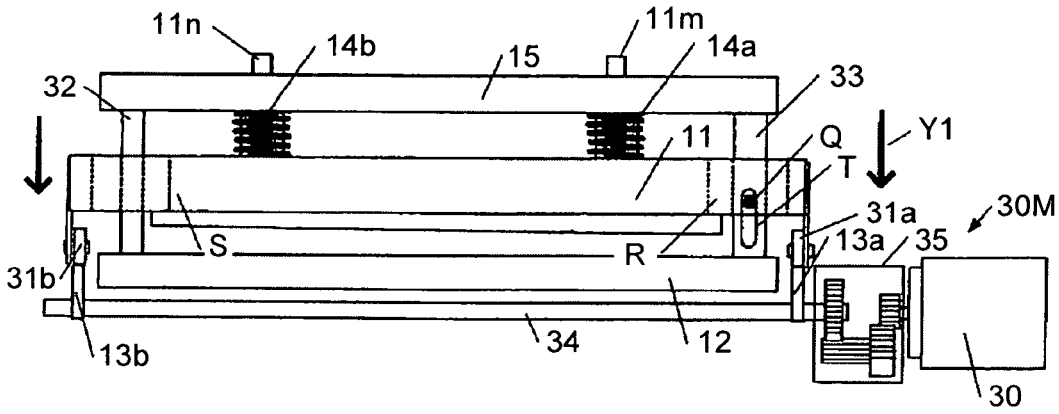
FIG. 15 is a schematic illustration of operations performed to crease a sheet by using a creasing member, illustrating an initial position where the creasing member is positioned uppermost.

More specifically, when the drive motor 30 starts rotating from the state (where a sheet has been conveyed to and stopped at the creasing position), which corresponds to an initial position, illustrated in FIG. 15, the camshaft 34 is rotated via the drive gear train 35, which in turn rotates the first and the second cams 13*a* and 13*b*. As the first and the second cams 13*a* and 13*b* rotate, the first and the second positioning members 31*a* and 31*b*, which are the cam followers that are to abut on and roll on the first and the second cams 13*a* and 13*b*, are rotated, causing a center distance between the positioning members 31*a* and 31*b*, and the first and the second cams 13*a* and 13*b* to change, thereby moving the creasing member 11 in a direction indicated by Y1.

Figure 16:
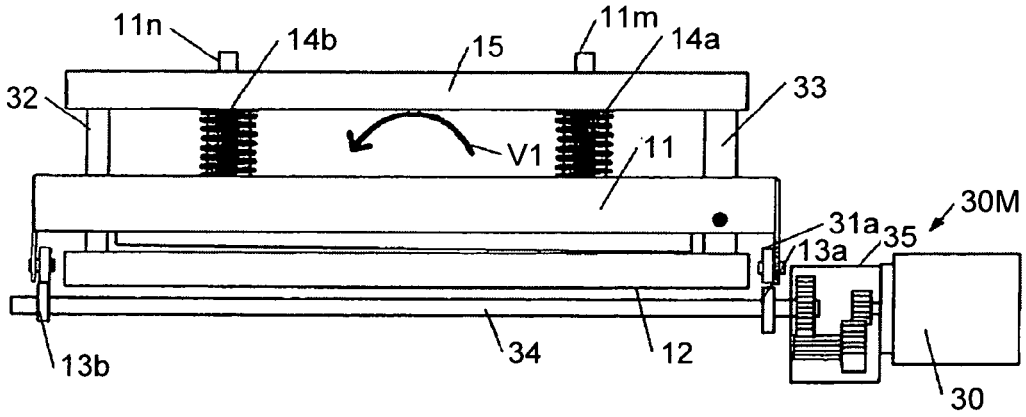
FIG. 16 is a schematic illustration of the operations performed to crease the sheet by using the creasing member, depicting a state where a creasing blade abuts on a creasing channel at one point.
Figure 17:
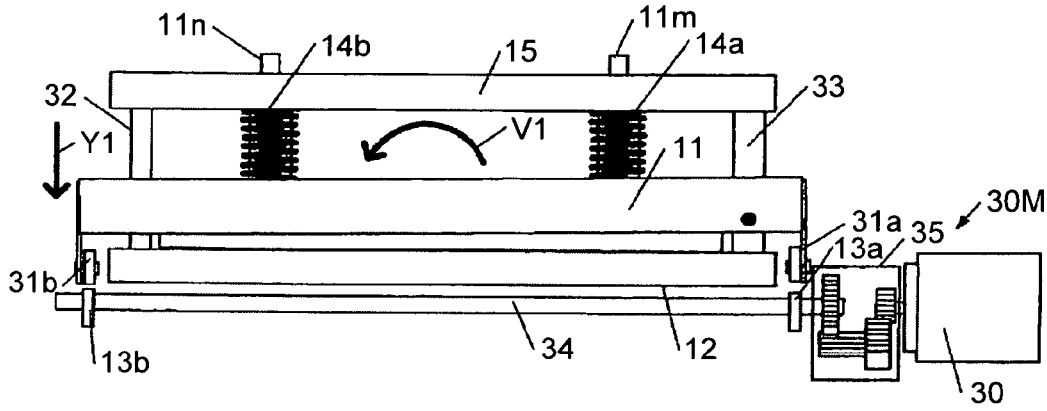
FIG. 17 is a schematic illustration of the operations performed to crease the sheet by using the creasing member, illustrating a state where the creasing blade abuts on the creasing channel to perform creasing.

When the creasing blade 11*a* abuts on the creasing channel 12*a* of the receiving member 12 as illustrated in FIG. 16, the receiving member 12 prevents the creasing member 11 from moving farther. When the drive motor 30 further rotates from this state, the first positioning member 31*a* and the first cam 13*a* are separated from each other. At this time, the second positioning member 3l*b* is in contact with the second cam 13*b* because a front portion, in the device, of the creasing blade 11*a* of the creasing member 11 does not abut on the receiving member 12. An abutting position where the creasing blade 11*a* abuts on the creasing channel 12*a* of the receiving member 12 is out of a range where sheets are conveyed; accordingly, as abutting portion changes after the creasing blade 11*a* has abutted on the creasing channel 12*a*, the creasing blade 11*a* and the creasing channel 12*a* come to pinch and be in contact with a sheet.

When the drive motor 30 further rotates from the state illustrated in FIG. 16, the front portion, in the device, of the creasing blade 11*a* is also brought into contact with the creasing channel 12*a* of the receiving member 12. Accordingly, resilient forces of the first and the second resilient members 14*a* and 14*b* apply a pressure onto the sheet P, forming a crease in the sheet P.

Figure 18:
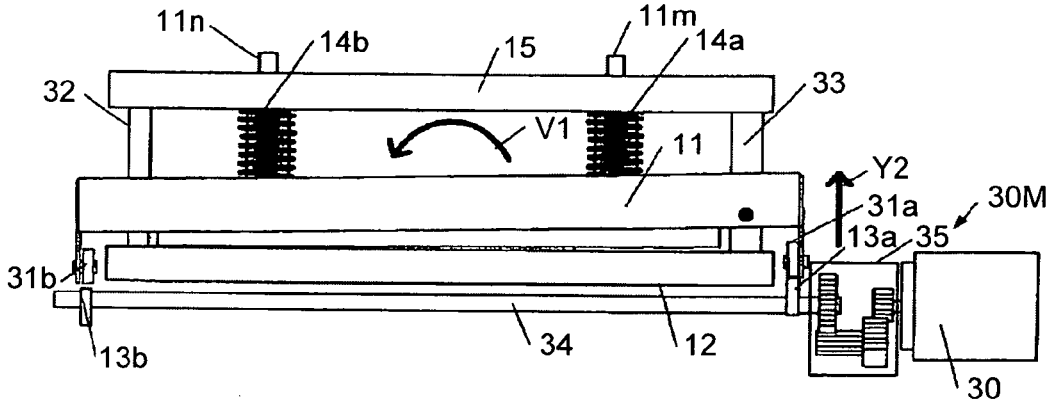
FIG. 18 is a schematic illustration of the operations performed to crease the sheet by using the creasing member, illustrating a state where an abutting position where the creasing blade abuts on the creasing channel moves toward a front side of the device so that the abutting position moves past the sheet.
Figure 19:
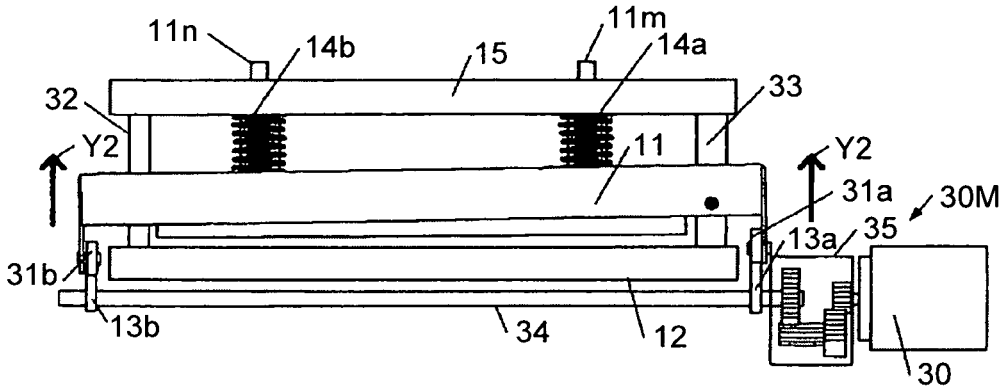
FIG. 19 is a schematic illustration of the operations performed to crease the sheet by using the creasing member, illustrating a state where the creasing blade is separated from the receiving member.

After the crease has been formed, the drive motor 30 further rotates, causing the camshaft 34 and the first and the second cams 13*a* and 13*b* to rotate. Then, as illustrated in FIG. 18, the first positioning member 31*a* and the first cam 13*a* are brought into contact with each other earlier than the second positioning member 31*b* and the second cam 13*b*, and the first cam 13*a* pushes up the first positioning member 31*a* at a rear, moving up a rear portion of the creasing member 11 in a direction indicated by an arrow Y2 earlier than a front portion of the creasing member 11. As illustrated in FIG. 19, when a bottom end of a portion of the creasing blade 11*a*, which is at the rear, or, put another way, is near the first positioning member 31*a*, is separated from the receiving member 12, the second positioning member 31*b* and the second cam 13*b* at the front, in the device, come into contact with each other, and a portion of the creasing member 11 near the positioning member 31*b* also ascends in the direction indicated by the arrow Y2.

Figure 20:
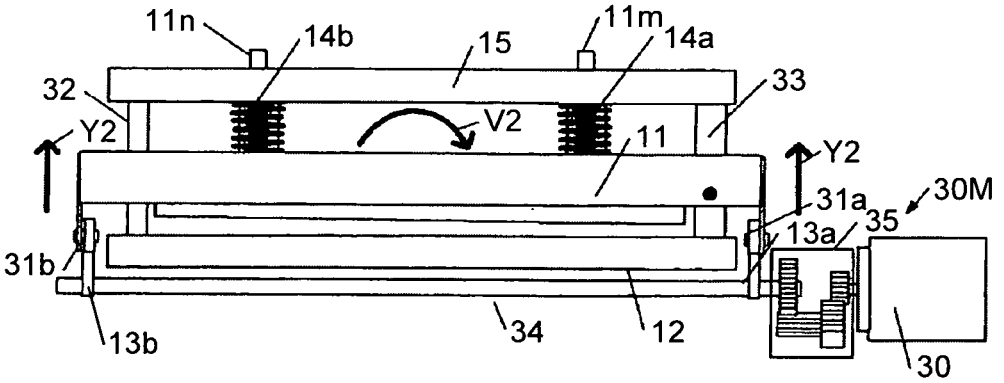
FIG. 20 is a schematic illustration of the operations performed to crease the sheet by using the creasing member, illustrating a state where, after being separated from the receiving member, the creasing member pivots in a reverse direction to return to an initial state.

The bottom end of the portion of the creasing blade 11*a* near the first positioning member 31*a* is temporarily stopped at the position separated from the receiving member 12. When a top surface of the creasing member 11 is oriented horizontally as illustrated in FIG. 20, the creasing member 11 ascends while maintaining the horizontal orientation to return to a standby position, or, put another way, the initial position illustrated in FIG. 14. At the initial position, the creasing blade 11*a* is inclined such that the rear portion of the creasing blade 11*a* is closer to the receiving member 12 than the front portion is.

In this process, as illustrated in FIG. 16, after the creasing blade 11*a* has abutted on the receiving member 12 at the rear portion in the device, the creasing blade 11*a* rotates counterclockwise (indicated by an arrow V1) in FIG. 16. After both end portions of the creasing member 11 have ascended in the direction indicated by the arrow Y2 in FIG. 19, the creasing member 11 pivots clockwise (in the direction indicated by an arrow V2) as illustrated in FIG. 20. The creasing member 11 is thus constructed as if it functions as an arcuate blade (the creasing blade 11*a*)having a pivot center at a rear portion in the device to produce a crease by going through a motion similar to that of a cutter that has a pivot point at its end and performs cutting with a pressure exerted thereon. This motion is produced by the shapes of the first and the second cams 13*a* and 13*b*.

FIG. 21A to FIG. 21E are schematic illustrations of operations and illustrating how positional relationship between the receiving member 12 and the creasing member 11 changes as positional relationship between the cams 13*a* and 13*b* and the positioning members 31*a* and 31*b* changes. In FIG. 21A to FIG. 21E, relationships between rotational positions of the first cam 13*a* and those of the first positioning member 31*a* at the rear portion in the device are depicted on the right-hand side; relationships between rotational positions of the second cam 13*b* and those of the second positioning member 31*b* at the front portion in the device are depicted on the left-hand side. Positional relationships between the creasing channel 12*a* of the receiving member 12 and the creasing blade 11*a* of the creasing member 11 that depend on rotations of the first and the second cams 13*a* and 13*b* are depicted at a center portion between the right-hand side and the left-hand side.

Figures 21A, 21B, 21C, 21D, 21E:
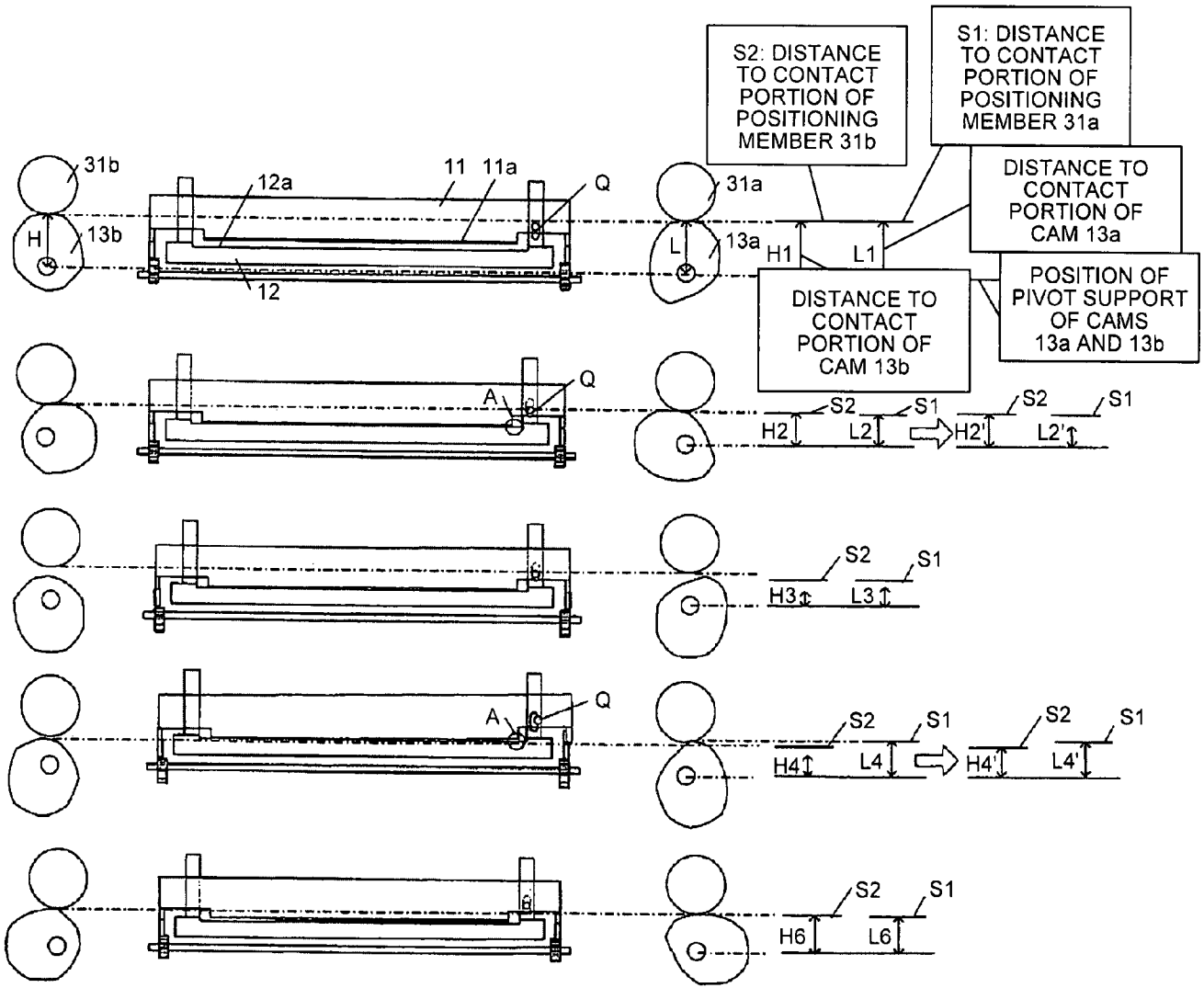
FIG. 21A to FIG. 21E are schematic illustrations of operations and illustrating how positional relationship between the receiving member and the creasing member changes as positional relationship between cams and positioning members changes.

FIG. 21A illustrates a position of the creasing blade 11*a* relative to the receiving member 12 in a period where a sheet is conveyed into the device, conveyed to a folding position, and stopped at a folding position. This position is the initial position. In FIG. 21A to FIG. 21E, L denotes a distance from the center of the rotating shaft (the camshaft 34) of the first cam 13*a* to a point of contact (on an outer peripheral surface of the first cam 13*a*) between the first positioning member 31*a* and the first cam 13*a* on a straight line connecting the center of the rotating shaft (the camshaft 34) of the first cam 13*a* and the center of the rotating shaft of the first positioning member 31*a*. H denotes a distance from the center of the rotating shaft of the second cam 13*b* to a point of contact (on an outer peripheral surface of the second cam 13*b*) between the second positioning member 31*b* and the second cam 13*b* on a straight line connecting the center of the rotating shaft of the second cam 13*b* and the center of the second positioning member 31*b*.

When, in FIG. 21A, denoting a distance to a contact position of the first positioning member 31*a* with the first cam 13*a* by S1 and denoting a distance to a contact position of the second positioning member 31*b* with the second cam 13*b* by S2, relationships among the distance S1, the distance L1, the distance S2, and the distance H1 can be expressed by the following equations.

$$S1=L1$$

$$S2=H1$$

$$H1=L1$$

In this state, the creasing blade 11*a* and the creasing channel 12*a* are in the positional relationship illustrated in FIG. 15, where a clearance between the creasing blade 11*a* and the creasing channel 12*a* are the same between at rear and front. Meanwhile, H denotes the distance to a contact point of the second cam 13*b* with a corresponding one of the cam followers; L denotes the distance to a contact point of contact of the first cam 13*a* with a corresponding one of the cam followers.

FIG. 21B illustrates relevant elements in a state where a portion A, which is a rearmost portion of the creasing blade 11*a*, has come into contact with the receiving member 12. The portion A is located farther outside than an edge of a sheet to be creased having a maximum size in the present embodiment. A front portion of the creasing blade 11*a* pivots about the portion A at an outer portion (rear portion) to descend. A relationship between the distance H2 and the distance L2 for a period from a start of the operation until the portion A of the creasing blade 11*a* comes into contact with the receiving member 12 can be expressed by the following equation.

$$H2=L2$$

That is, the front portion and the rear portion of the creasing blade 11*a* move (descend) by the same distance concurrently. FIG. 16 illustrates this positional relationship.

In a state where the first and the second cams 13*a* and 13*b* are further rotated after the portion A has come into contact with the receiving member 12, as illustrated in FIG. 21B, relationships between the distance S1 and the distance L2', and the distance S2 and the distance H2' can be expressed by the following expressions.

$$S1>L2'$$

$$S2=H2'$$

In this process, the creasing member 11 rotates about the rotating shaft Q.

FIG. 21C illustrates a position in a state where the creasing member 11 has pivoted about the rotating shaft Q and a blade face of the creasing blade 11*a* has come into contact with the creasing channel 12*a* of the receiving member 12. As illustrated in FIG. 21C, relationships between the distance S1 and the distance L3, and the distance S2 and the distance H3 at a time of this contact can be expressed by the following expressions.

$$S1>L3$$

$$S2>H3$$

The distances L and H are smaller than the distance S at both front and rear portion of the creasing blade 11*a*. Hence, the resilient members 14*a* and 14*b* press the creasing member 11 to cause the creasing blade 11*a* to be fitted into the creasing channel 12*a* of the receiving member 12 with a sheet therebetween, thereby producing a crease in the sheet. FIG. 26 illustrates this positional relationship.

FIG. 21D illustrates a position in a state where the portion A of the creasing blade 11*a* separates from the receiving member 12. Relationships between the distance S1 and the distance L4, and the distance S2 and the distance H4 at this separation can be expressed by the following expressions.

$$S1=L4$$

$$S2>H4$$

Thereafter, the positional relationships shift to positional relationships that can be expressed by the following equations.

$$S1=L4'$$

$$S2=H4'$$

FIG. 18 illustrates this positional relationship.

Meanwhile, the distance S1 at the rear portion is kept constant until the distance S2 at the front portion reaches the distance at the rear side. After a relationship expressed by S1=S2 has been established as illustrated in FIG. 21E, the creasing blade 11*a* returns to the standby position illustrated in FIG. 21A.

The shapes of the first and the second cams 13*a* and 13*b* are configured such that a speed, at which the creasing blade 11*a* moves away from the receiving member 12, increases after the creasing blade 11*a* has started moving away from a state illustrated FIG. 21D. In the example illustrated in FIG. 16, the creasing blade 11*a* is straight in shape and inclined relative to the surface of the receiving member 12; alternatively, for instance, the creasing blade 11*a* can have an arcuate shape that is convex downward.

By performing the operations mentioned above, sheets P are creased on a sheet-by-sheet basis and then conveyed into the folding device B.

Figure 30:
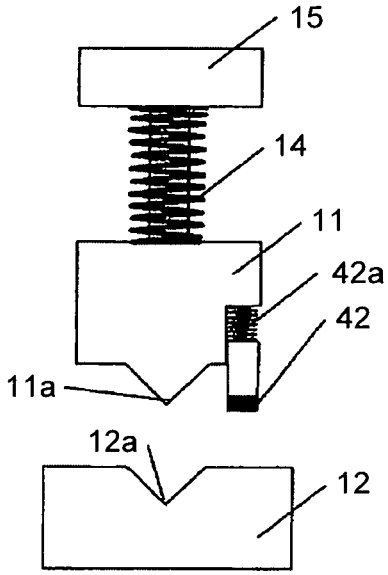
FIG. 30 is a schematic diagram illustrating an example where a pressure exerted by the sheet retaining member is nonuniform.

As mentioned above, retaining sheets during sheet edge trimming is a known technique. FIG. 30 illustrates an example of a configuration of a creasing device, to which a mechanism for retaining sheets in this manner is applied. FIG. 30 is a schematic diagram illustrating an example where a retaining member is provided on the creasing member of the creasing device. In this example, the retaining member 42, which is of the same length as the creasing member 11, is provided on a bottom surface of the creasing member 11 at an upstream position in the sheet conveying direction and oriented parallel to the creasing blade 11*a*, or, put another way, in the direction perpendicular to the sheet conveying direction. The retaining member 42 is supported via a resilient member 42*a*, such as a resilient coil spring, thereby allowing the retaining member 42 to move in a direction perpendicular to the top surface of the receiving member 12 in a predetermined range. Referring to FIG. 30, reference symbol 11*a* denotes the creasing blade, and 12*a* denotes the creasing channel; creasing is performed by pinching a sheet therebetween with pressure.

In the creasing member 11 configured in this manner, the sheet retaining member 42 is gradually brought into contact with a sheet from a sheet edge because the sheet retaining member 42 operates in the same manner as the creasing member 11. Accordingly, a portion of a sheet where the sheet retaining member 42 retains the sheet gradually changes during the creasing process. This can cause displacement of the sheet during the creasing process to occur. Hence, it will be difficult to prevent displacement even when such a mechanism as discussed above is introduced.

Figure 22:
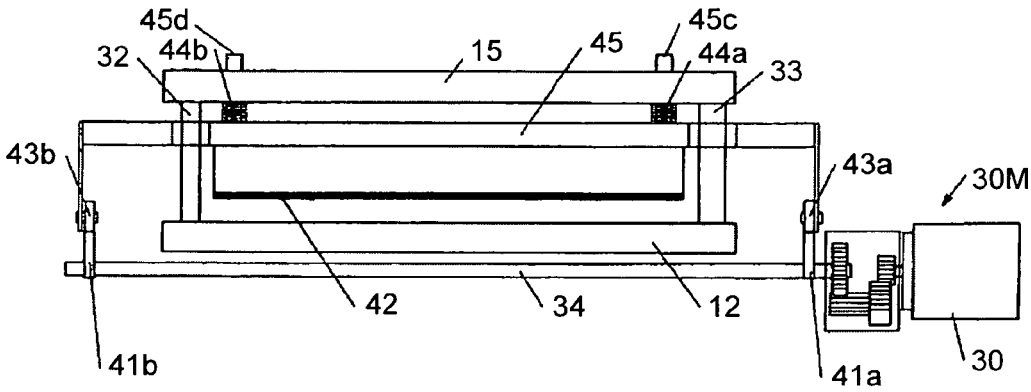
FIG. 22 is a schematic elevation view of a sheet retaining mechanism according to an embodiment.
Figure 23:
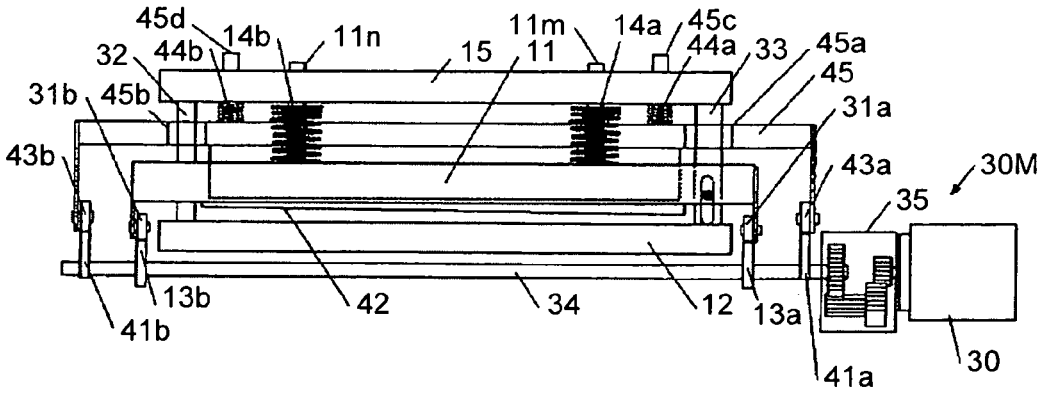
FIG. 23 is a schematic elevation view of a main part of the creasing device, in which a creasing mechanism and the sheet retaining mechanism are combined, according to the embodiment.
Figure 24A:
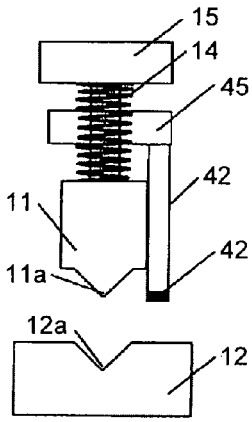
FIG. 24A to FIG. 24C are schematic operation explanatory diagrams illustrating relationships between the creasing member and a sheet retaining member.
Figure 24B:
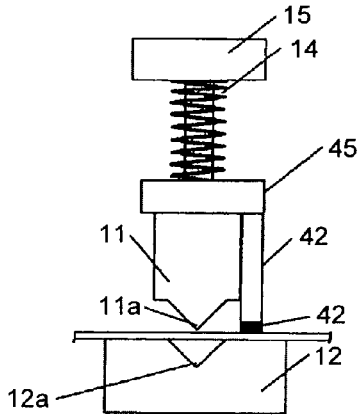
Figure 24C:
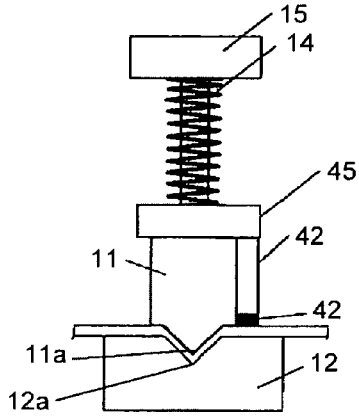

FIG. 22 is a schematic elevation view of a sheet retaining mechanism according to the present embodiment. FIG. 23 is a schematic elevation view of a main part of the creasing device, in which the creasing mechanism and the sheet retaining mechanism are combined, according to the embodiment. FIG. 24A to FIG. 24C are schematic side views of the main part of FIG. 23 and illustrating relationships between the creasing member and the sheet retaining member. The creasing mechanism is the same as that discussed above with reference to FIG. 13 and FIG. 14, and redundant explanations about the creasing mechanism are omitted.

The sheet retaining member 42 is longer than the width of the sheet in view of the conveying direction so that the sheet retaining member 42 can reliably retain the sheet across the full width of the sheet. An elastic material, such as rubber, that causes less damage to a sheet and is less likely to skid on the sheet, is attached to a distal end portion 42*b* of the retaining member 42 because the retaining member 42 comes into contact with a sheet at the distal end portion 42*b*. The retaining member 42 is attached to a support 45, which is independent from the creasing member 11. The support 45 is located between the creasing member 11 and the spring fixing member 15 and urged toward the sheet conveyance path by a spring 44*a* and a spring 44*b* fixed to a bottom surface of the spring fixing member 15. A first guide hole 45*a* and a second guide hole 45*b*, into which the first support shaft 33 and the second support shaft 32 are to be loosely fit, respectively, are defined in the support 45. The first and the second guide holes 45*a* and 45*b* allow the sheet retaining member 42 to travel and serve as a guide for the same.

As illustrated in FIG. 23, the third positioning member 43*a* and the fourth positioning member 43*b* similar to an ascending-and-descending mechanism of the creasing member 11 are attached to two end portions of the support 45. The third and the fourth positioning members 43*a* and 43*b* are brought into contact with a third cam 41*a* and a fourth cam 41*b* attached to the camshaft 34 that moves the creasing member 11, thereby controlling a position of the retaining member 42 in up and down directions.

Accordingly, running the drive motor 30, which is the drive source of the creasing member 11, causes the third and the fourth cams 41*a* and 41*b* to rotate, which in turn moves the sheet retaining member 42 in a direction substantially perpendicular to the sheet conveying direction concurrently with the creasing process to retain a sheet. Put another way, the sheet retaining member 42 and the creasing member 11 ascend and descend in a synchronized manner in a positional relationship that depends on a relationship between the cams and the positioning members.

It is desirable that the sheet retaining member 42 is located near the creasing member 11 in the conveying direction. In this time, a similar effect can be yielded regardless of whether the retaining member 42 is located upstream or downstream of the creasing member 11 in the conveying direction. The sheet retaining member 42 is located at a position upstream of the creasing member 11 in the conveying direction in the present embodiment. Accordingly, in a case where sheet jam in the conveying path occurs, a user removing a jammed sheet is prevented from accessing a portion under the creasing member 11, and therefore his/her hand is protected from touching the creasing blade 11*a*. Meanwhile, when the sheet retaining member 42 is provided downstream of the creasing member 11, a one-way clutch is desirably mounted on the second conveying rollers 2 so as to allow a sheet to be moved in the conveying direction. This allows a sheet to be moved so that the sheet can be creased.

FIG. 24A illustrates an initial state where none of retaining and creasing is performed yet. FIG. 24B illustrates a state where the creasing member 11 and the retaining member 42 have descended from the initial state and the retaining member 42 presses the sheet P to retain the sheet P. FIG. 24C illustrates a state where the retaining member 42 presses the sheet P to retain the sheet P and the creasing member 11 and the creasing blade 11*a* have descended to a creasing position, thereby producing a crease in the sheet P.

Figure 25:
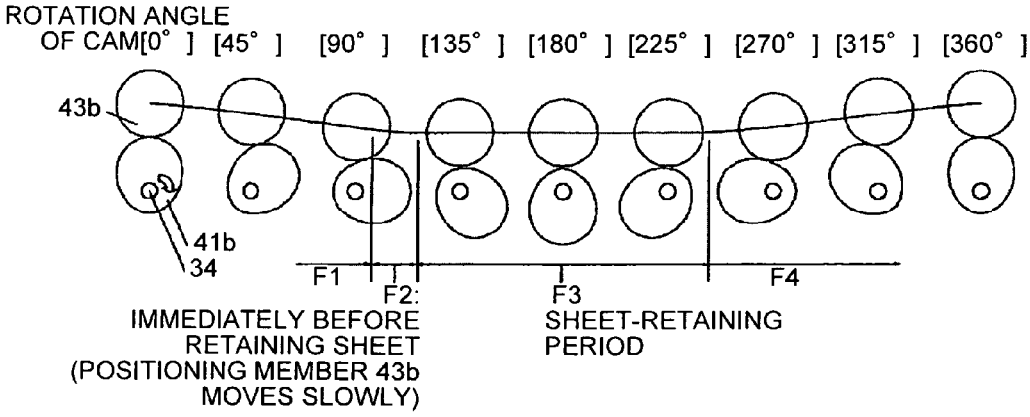
FIG. 25 is a schematic explanatory diagram illustrating relationships between rotation angles of a cam and positions of the positioning member for illustration how a drive mechanism of the sheet retaining member operates.

FIG. 25 is a schematic explanatory diagram illustrating relationships between rotation angles of the fourth cam 41*b* and positions of the fourth positioning member 43*b* for illustration how a drive mechanism of the sheet retaining member operates. As a matter of course, the third cam 41*a* having the same axis, or the camshaft 34, as that of the fourth cam 41*b* and the third positioning member 43*a* are located behind the fourth cam 41*b* and the fourth positioning member 43*b*. FIG. 25 illustrates changes of the position of the fourth positioning member 43*b* relative to a rotation angle of the fourth cam 41*b*. Ascending and descending of the sheet retaining member 42 reflect a change of the position of the fourth positioning member 43*b*. Accordingly, a traveling speed, at which the sheet retaining member 42 comes into contact with the sheet, can be controlled by controlling the third and the fourth cams 41*a* and 41*b*.

More specifically, to prevent damage to the sheet and displacement of the sheet that may otherwise be caused by contact between of the distal end portion 42*b* of the sheet retaining member 42 and the sheet, a traveling speed, at which the sheet retaining member 42 descends, for a period (period F2) immediately before the contact is set low, while a traveling speed for a sheet-retaining period F3 is set such that the sheet retaining member 42 retains the sheet without fail for a duration that depends on the creasing speed, at which the creasing member 11 performs creasing. For a period (period Fl) prior to the period immediately before the contact and a period (period F4), over which the sheet retaining member 42 moves away from the sheet, the conveying speed of the sheet is set high to maintain productivity.

In a situation where the rotation speed of the drive motor 30 is constant, a vertical traveling speed of the sheet retaining member 42 depends on an amount of a change in a length in a radial direction of the third and the fourth cams 41*a* and 41*b* per a change in a rotation angle of the same. As illustrated in FIG. 25, the traveling speed of the sheet retaining member 42 can be controlled while maintaining the rotation speed of the drive motor 30 constant by causing the amount of the change in the length in the radial direction of the third and the fourth cams 41*a* and 41*b* per the change in the rotation angle of the same to be relatively small over a period from immediately before the sheet retaining member 42 comes into contact with the sheet and to a time when the contact is made.

FIG. 26 is a schematic diagram illustrating an example where the first spring fixing unit 50*a* and the second spring fixing unit 50*b* that can be moved up and down by a drive source (not shown) are provided on the sheet retaining mechanism illustrated in FIG. 22 and FIG. 23, and the first spring 44*a* and the second spring 44*b* are mounted on a bottom surface of the first spring fixing unit 50*a* and a bottom surface of the second spring fixing unit 50*b*, respectively. The first and the second spring fixing units 50*a* and 50*b* can be provided by, for instance, cutting a male thread in each of an outer periphery of a first pin 45*c* and an outer periphery of a second pin 45*d* standing upright on the support 45 while cutting a female thread in each of an inner periphery of the first spring fixing unit 50*a* and an inner periphery of the second spring fixing unit 50*b*, respectively, and rotatably attaching the first and the second spring fixing units 50*a* and 50*b* to the spring fixing member 15 by screwing the male threads into the female threads.

Alternatively, the first and the second spring fixing units 50*a* and 50*b* can be configured as rotating members each having a male thread to be screwed into female threads provided by cutting threads in the spring fixing member 15.

Figure 27:
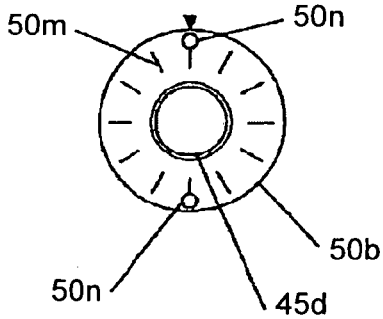
FIG. 27 is a plan view of a main part of an example of a pressure-adjusting unit in the pressure-adjusting mechanism illustrated in FIG. 26.

This allows the pressure to be exerted by the sheet retaining member 42 on a sheet to be adjusted by rotating the first and the second spring fixing units 50*a* and 50*b* to vertically move positions of the first and the second spring fixing units 50*a* and 50*b*. Meanwhile, a scale 50*m* is desirably marked on each of top surfaces of the first and the second spring fixing units 50*a* and 50*b* as illustrated in FIG. 27 so that degrees of rotations of the first and the second spring fixing units 50*a* and 50*b* can be checked. This allows elastic forces of the first and the second spring fixing units 50*a* and 50*b* to be adjusted based thereon.

The higher the pressure exerted by the sheet retaining member 42, the more effectively displacement of the sheet during creasing is prevented. However, in some type of paper, the sheet retaining member 42 can leave an impression on a print surface of a sheet when a high pressure is exerted thereon. Accordingly, it is desirable to adjust the pressure exerted by the sheet retaining member 42 by changing vertical positions of the first and the second spring fixing units 50*a* and 50*b* depending on a sheet condition. In the example illustrated in FIG. 27, a pair of holes 50*n*, into which a distal end of a tool can be inserted, is defined in two end portions of a top surface of the second spring fixing unit 50*b* so that the second spring fixing unit 50*b* can be manually rotated by inserting an engaging portion of a tool into the holes 50*n*. A rotation angle is indicated by the scale 50*m* and an inverted filled-in triangle mark. Alternatively, a mechanism that includes a known tool, with which a rotating member can be rotated, can be employed. Further alternatively, a technique of performing electric control by using a motor can be employed.

The thicker the thickness of a sheet, the more likely an impression is left by the sheet retaining member 42. In a situation where the sheet P is special paper, such as coated paper, or a situation where a print area in a portion where the sheet retaining member 42 contacts the sheet P is large, an impression is more conspicuous. To that end, a pressure to be exerted by the sheet retaining member 42 is desirably selected from P1, P2, and P3 depending on S1, which is a predetermined sheet thickness, C1, which is a print area in a contact portion between the sheet retaining member 42 and the sheet, and whether the sheet is special paper. Here, the pressures satisfies P1<P2<P3.

Figure 28:
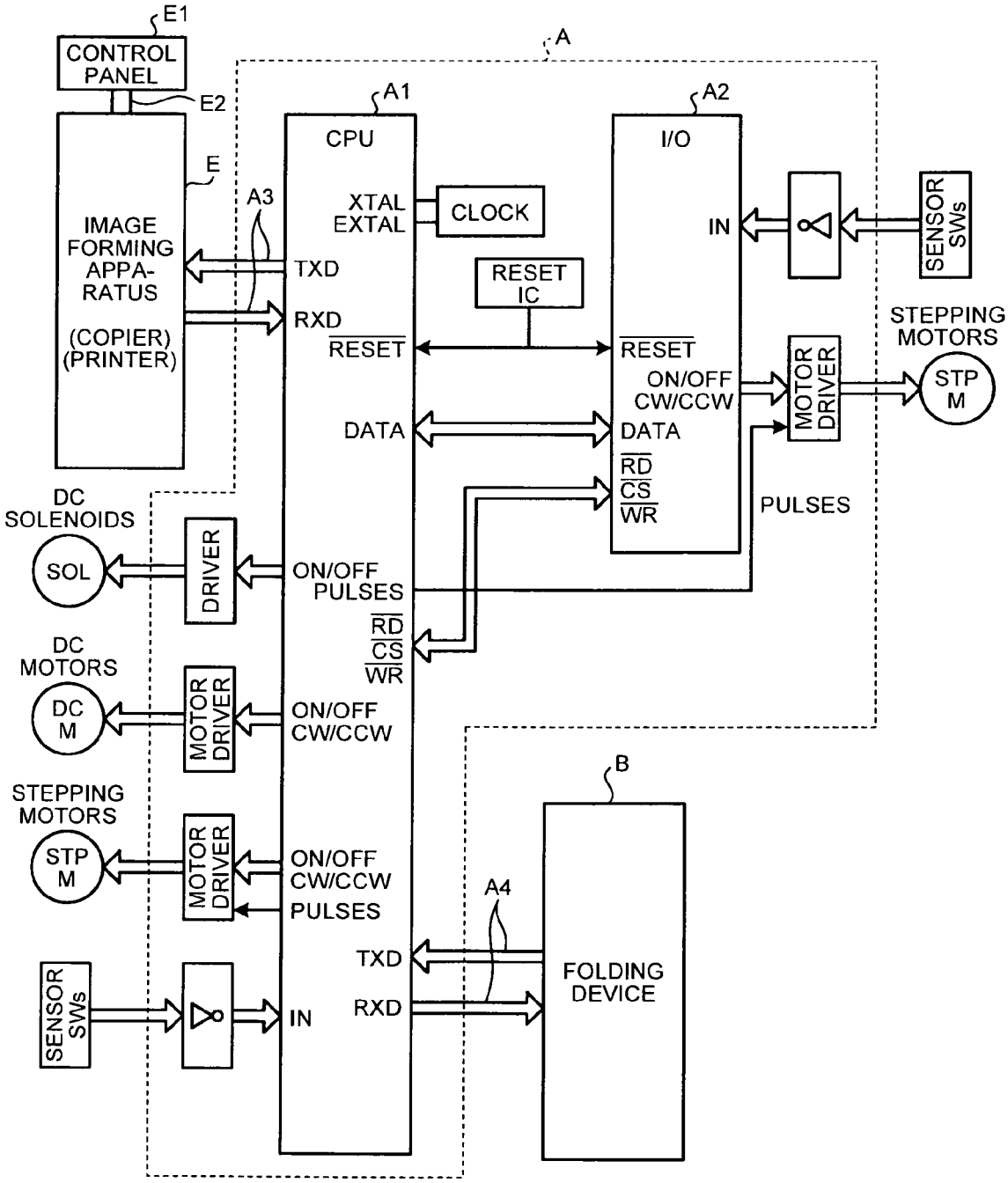
FIG. 28 is a block diagram illustrating a control structure of the image forming system including the creasing device, the folding device that performs folding, and the image forming apparatus.

FIG. 28 is a block diagram illustrating a control structure of the image forming system including the creasing device A, the folding device B that performs folding, and the image forming apparatus E. The creasing device A includes a control circuit equipped with a microcomputer including a central processing unit (CPU) A1 and an input/output (I/O) interface A2. Various signals are fed to the CPU A1 via a communications interface A3 from the CPU, various switches on a control panel E1, and various sensors (not shown) of the image forming apparatus E. The CPU A1 performs predetermined control operations based on a thus-fed signal. The CPU A1 receives signals similar to those mentioned above from the folding device B via a communications interface A4 and performs predetermined control operations based on a thus-fed signal. The CPU A1 also performs drive control for solenoids and motors via drivers and motor drivers and obtains detection information from sensors in the device via the interface. The CPU A1 also performs drive control for motors and obtains detection information from sensors via the I/O interface A2 and via motor drivers for some entities to be controlled and some sensors. The CPU A1 performs the control operations discussed above by reading program codes stored in read only memory (ROM) (not shown), performing deployment processing with random access memory (RAM) (not shown), and executing program instructions defined by the program codes while using the RAM as a working area and data buffer.

The creasing device A illustrated in FIG. 28 is controlled according to an instruction or information fed from the CPU of the image forming apparatus E. An operating instruction is input by a user from the control panel E1 of the image forming apparatus E. The image forming apparatus E and the control panel E1 are connected to each other via a communications interface E2. Accordingly, an operation signal input from the control panel E1 is transmitted from the image forming apparatus E to the creasing device A and to the folding device B. A user is notified of operation status and functions of the devices A and B via the control panel E1.

Figure 29:
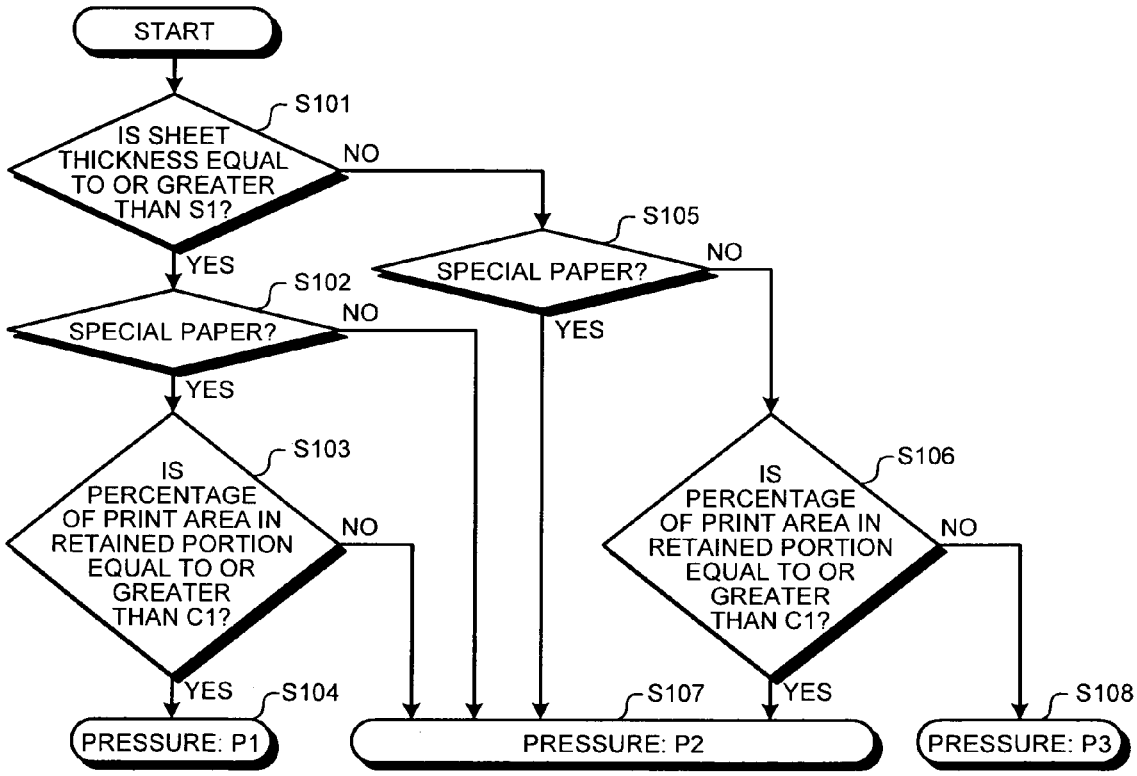
FIG. 29 is a flowchart of operations of determining a pressure to be exerted by the sheet retaining member.

FIG. 29 is a flowchart for operations to be performed by the CPU A1 of the creasing device A to determine a pressure to be exerted by the sheet retaining member 42. In this operation procedure, determination of the thickness of a sheet (Step S101), determination as to whether the sheet is special paper or ordinary paper (Steps S101 and S105), and determination of a print area in a retained portion are made.

If the thickness of the sheet is equal to or greater than S1 (YES at Step S101), the sheet is special paper (YES at Step S102), and the percentage of the print area in the retained portion is equal to or greater than C1, which has been determined in advance, (YES at Step S103), the pressure is set to P1 (Step S104).

If the sheet is not special paper at Step S102, if the percentage of the print area in the retained portion is smaller than C1 at Step S103, if the thickness of the sheet is smaller than S1 (NO at Step S101) and the sheet is special-paper (YES at Step S105), or if the sheet is not special paper at Step S105 and the percentage of the print area in the retained portion is greater than C1, the pressure is set to P2 (Step S107).

If the percentage of the print area in the retained portion is smaller than C1 at Step S106, the pressure is set to P3 (Step S108).

In a configuration where the first and the second spring fixing units 50*a* and 50*b* are rotated by using a motor, it is possible to automatically adjust the pressure to be exerted onto a sheet by driving the motor according to the set value P1, P2, or P3.

The set values P1, P2, and P3 can be displayed on a display unit of the control panel E1 of the image forming apparatus E. This allows a user to perform adjustment by using a tool while referring to the scale 50*m* illustrated in FIG. 27.

The operations in the flowchart can be executed by the CPU in the image forming apparatus E. For the configuration where the set values P1, P2, and P3 are displayed, this can be performed only by the image forming apparatus E.

As discussed above, according to the present embodiment, effects including the following effects are yielded.

1) The creasing blade 11*a* and the creasing channel 12*a* come into contact with each other such that the contact starts from a point contact and develops in one direction into an area contact so that pressure exerted to perform creasing is dispersed. Accordingly, load to be placed during creasing can be reduced.
2) The sheet retaining member 42 is driven during creasing by the motor 30, which is the drive source that drives the creasing member 11, and capable of retaining a sheet across the full width of the sheet all together along a direction perpendicular to a sheet convening direction.
3) This prevents displacement of the sheet during creasing.

It should be understood that the present invention is not limited to the embodiments, and it is intended to cover all various modifications as may be included within the spirit and scope as set forth in the appended claims.

According to an aspect of the present invention, when creasing is performed by bringing a convex blade and a concave blade into contact with a sheet interposed therebetween such that the contact starts from a point contact and develops in one direction, a sheet retainer, which is driven by a drive force of a driving unit that performs creasing, retains the sheet across a full width of the sheet in a retained state during creasing. Accordingly, creasing and prevention against sheet displacement can be achieved easily by using the single drive source.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device that creases sheets on a per-sheet basis, the creasing device comprising:

a first member extending in a direction perpendicular to a sheet conveying direction and including a creasing blade, the;

a second member extending in a direction perpendicular to the sheet conveying direction and including a creasing channel, the creasing channel allowing the creasing blade to be fitted thereinto with a sheet interposed between the creasing channel and the creasing blade;

a drive unit that brings the first member and the second member into and out of contact with each other to cause a sheet stopped at a predetermined position to be pinched between the first and the second members and creased;

a sheet retainer driven by the drive unit and brought into contact with a top surface of the second member with the sheet interposed between the sheet retainer and the second member to retain the sheet across a full width of the sheet; and a holding unit that holds the sheet retainer in a retaining state during creasing where the creasing blade and the creasing channel come into contact with each other with the sheet interposed therebetween, the contact starting at one point and developing in one direction, wherein the creasing blade and the creasing channel are configured to come into contact with each other starting at a first end of the first member and proceeding linearly to a second end of the first member.

2. The creasing device of claim 1, wherein the sheet retainer includes:

a sheet retaining member that is longer than a length of the sheet in a direction, along which the sheet is creased, and is configured to be brought into contact with the sheet on a straight contact line; and that the drive unit moves the sheet retaining member toward and away from the second member, and the sheet retainer is driven by the drive unit in synchronization with the first member.

3. The creasing device of claim 1, wherein a position of the one point where the contact between the creasing blade and the creasing channel starts is a position where sheets of any size do not pass through.

4. The creasing device of claim 1, wherein the creasing blade and the creasing channel start separating from each other from a side where the contact between the creasing blade and the creasing channel starts.

5. The creasing device of claim 1, wherein a traveling speed of the sheet retainer decreases immediately before the sheet retainer comes into contact with the sheet.

6. The creasing device of claim 1, wherein a traveling speed of the sheet retainer increases after the sheet retainer has been separated from the sheet.

7. The creasing device of claim 1, further comprising a pressure changing unit that changes a pressure to be exerted by the sheet retainer on the sheet depending on a thickness of the sheet.

8. The creasing device of claim 1, further comprising a pressure changing unit that changes a pressure to be exerted by the sheet retainer on the sheet according to information about whether the sheet is special paper.

9. The creasing device of claim 1, wherein a pressure to be exerted by the sheet retainer on the sheet is changed depending on a print area in a portion where the sheet retainer is in contact with the sheet.

10. An image forming system comprising:

a creasing device that crease sheets on a per-sheet basis; and an image forming apparatus that forms an image on the sheets, wherein the creasing device comprises:

a first member extending in a direction perpendicular to a sheet conveying direction and including a creasing blade;

a second member extending in a direction perpendicular to the sheet conveying direction and including a creasing channel, the creasing channel allowing the creasing blade to be fitted thereinto with a sheet interposed between the creasing channel and the creasing blade;

a drive unit that brings the first member and the second member into and out of contact with each other to cause a sheet stopped at a predetermined position to be pinched between the first and the second members and creased;

a sheet retainer driven by the drive unit and brought into contact with a top surface of the second member with the sheet interposed between the sheet retainer and the second member to retain the sheet across a full width of the sheet; and a holding unit that holds the sheet retainer in a retaining state during creasing where the creasing blade and the creasing channel come into contact with each other with the sheet interposed therebetween, the contact starting at one point and developing in one direction, wherein the creasing blade and the creasing channel are configured to come into contact with each other starting at a first end of the first member and proceeding linearly to a second end of the first member.

* * * * *